United States Patent [19]

Schimmel

[11] 4,175,329

[45] Nov. 27, 1979

[54] ATTACHMENT FOR MOTION TRANSLATING MACHINE

[75] Inventor: Otto K. Schimmel, Scottsdale, Ariz.

[73] Assignee: Amba Marketing Systems, Inc., Tempe, Ariz.

[21] Appl. No.: 892,257

[22] Filed: Mar. 31, 1978

[51] Int. Cl.[2] ..... B43L 13/10; D05B 21/00; D05C 9/04

[52] U.S. Cl. ..... 33/23 R; 112/102; 112/121.15

[58] Field of Search ..... 33/23 R, 23 K, 27 K, 33/25 R; 112/103, 102, 2, 121.15

[56] References Cited

U.S. PATENT DOCUMENTS

| | | | |
|---|---|---|---|
| 2,624,302 | 1/1953 | Meister | 112/102 |
| 2,881,521 | 4/1959 | Pearson | 33/25 R |
| 3,001,489 | 9/1961 | Bond et al. | 112/121.12 |
| 3,333,341 | 8/1967 | Wuerthner | 33/25 R |
| 3,451,366 | 6/1969 | Beck | 112/102 |

FOREIGN PATENT DOCUMENTS

| | | | |
|---|---|---|---|
| 991161 | 5/1965 | United Kingdom | 112/102 |
| 1321074 | 6/1973 | United Kingdom | 112/121.15 |

*Primary Examiner*—Harry N. Haroian
*Attorney, Agent, or Firm*—Gregory J. Nelson

[57] ABSTRACT

A gauging attachment for machines utilizing a pantograph mechanism including a gauging assembly having a master gauge plate adapted to be coupled to the pantograph mechanism. A series of gauges are selectively engageable with the gauge plate to correctly position the workpiece. A clamping plate secures the workpiece to the master plate and in engagement with the gauge. The entire gauging assembly moves in response to motion imparted to the pantograph at a stylus. The stylus is traced along templates selectively interchangeable in a removable template tray. The attachment is adjustable and once set maintains a predetermined position with respect to the workpiece to facilitate repetitive operations without further adjustment.

6 Claims, 13 Drawing Figures

ATTACHMENT FOR MOTION TRANSLATING MACHINE

The present invention relates to a machine for engraving and sewing and more particularly to an attachment to engraving and sewing machines having a pantograph mechanism for moving an object in a prescribed pattern for embroidering, engraving and similar operations.

Commercial sewing operations, such as embroidery and monogramming as well as engraving operations, are often carried out on machines incorporating motion translating devices such as pantograph mechanisms. Typical of this machine is a commercial sewing machine having two connected sets of pantographs cooperating with a monogram machine sewing head which sews a zig-zag stitch. The upper pantograph acts as a supporting assembly between a lower pantograph and a hoop arm assembly which supports the material to be monogrammed in a taut position at the machine head. The lower pantograph acts as a tracing mechanism and governs the movement of the hoop under the needle to form the monogram. The lower pantograph typically includes a stylus arm, an attached stylus, and a handle which the operator moves in a predetermined pattern or on a template to impart the corresponding motion at the hoop so that the monogram is sewn on the material secured at the hoop. Pantograph assemblies of this type are well known and are typified by the Meistergram Monogram Machine such as Models M100-J and M80-J.

The monogram machines of the type described above are effective and are particularly well suited for sewing monograms and similar designs on material. However, if the object to be sewn is not flexible material, it is not generally possible to secure the material in a hoop arrangement as is conventional. Therefore, commercial sewing and monogramming of heavy materials such as vinyl has been difficult. This is particularly true when the vinyl has been fabricated into an article such as a panel or flap on a lady's handbag. Therefore, the present invention provides a gauging attachment or assembly and a template attachment or assembly which can be utilized with conventional pantograph-type sewing and engraving machines for positioning by work pieces.

Briefly, the present invention provides a gauging assembly which can be attached to a pantograph or similar mechanical motion translating device at an adjustable coupling so that once the assembly is adjusted, repetitive operations can be performed without further adjustment. The gauging assembly includes a base master gauge plate which defines a central cut-out which in the working area. Clamping or fastening devices are secured to the master gauge plate. Pins project from the master gauge plate adjacent the cut-out and detachably secure a gauge to the plate. The gauge is configured to secure the work piece in the proper position over the cut-out. A clamping plate is placed over the work piece and is locked in position by the fastening devices on the gauge base plate, securing the work piece in position. As the pantograph stylus is moved in a template, the entire gauging assembly and work piece moves so that engraving or embroidery is imparted to the work piece.

The present invention also comprehends an improved template assembly. The template assembly includes a template base plate which is securable to the desk surface of the pantograph machine and includes adjustable means for securing a removable template tray on the plate. The template tray will accept templates carrying various indicia and designs. End plates are slidably received in the tray and may be quickly removed to facilitate interchange of the templates.

The above and other objects and advantages of the present invention will become more apparent from the following specification, claims and drawings in which:

Figure 1:
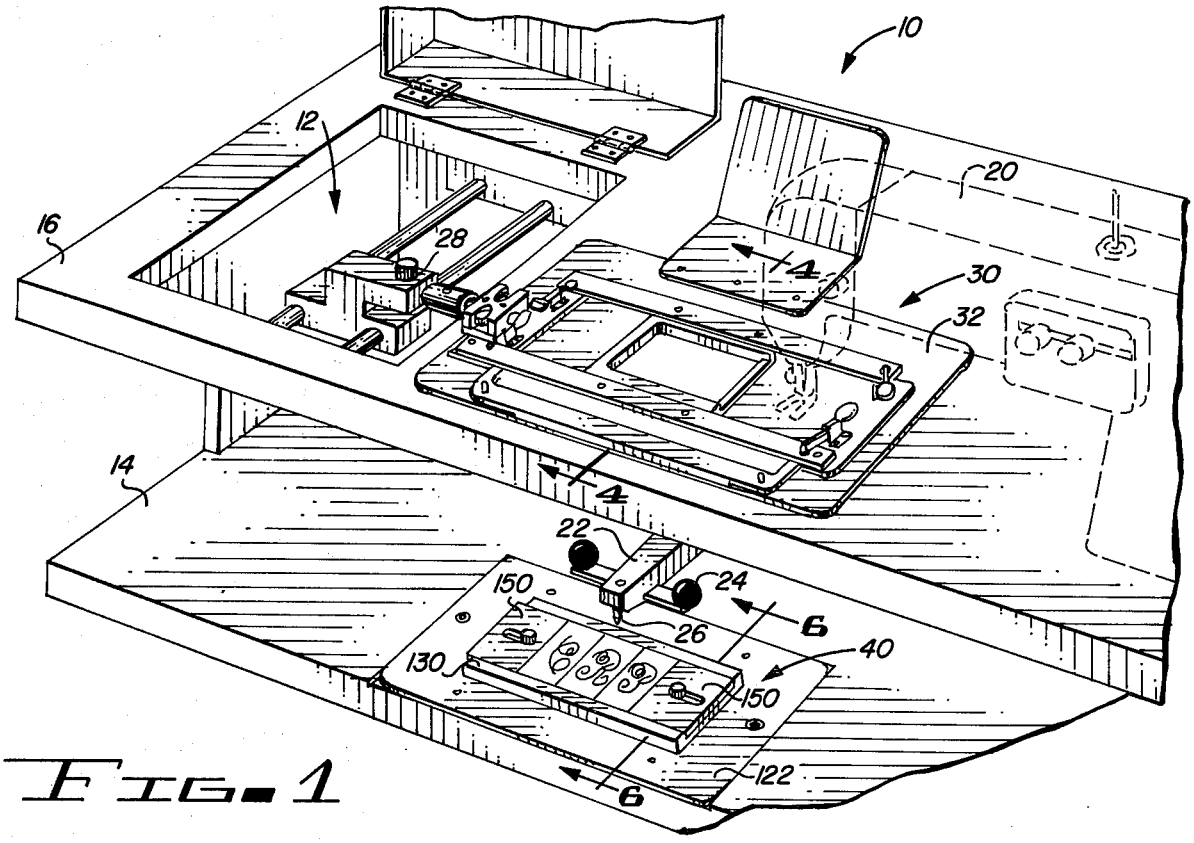
FIG. 1 is a perspective view of a portion of a monogram machine showing part of the pantograph assembly and the machine head in dotted with the gauging assembly and template assembly of the present invention attached to the machine.

Turning now to the drawings, FIG. 1 shows a portion of a monogram machine 10, having a motion translating the device 12 of the pantograph type secured between desk surface 14 and table top 16. It will be understood that machine 10, although shown as a monogram sewing machine may also be an engraving or similar type of machine. Similarly, the motion translating device 12, is shown as utilizing an upper and a lower pantograph, but may also be of various other types of motion translating mechanisms. For purposes of understanding and orientation, a sewing head 20 is shown in dotted. The pantograph device includes a stylus arm 22 and attached handle 24. A stylus 26 is carried on the underside of the stylus arm. Movement of stylus 26 through manipulation of handle 24 and stylus arm 22 is translated into an identical or proportional motion at the head or bracket 28 through the pantograph or motion translating mechanism 12. These parts of the machine are conventional in form and are not a part of the present invention.

The present invention is a gauging attachment or assembly generally designated by numeral 30 for securing a work piece in position during the sewing or engraving operation and which is cooperable with the motion translating device. The present invention also comprehends a template assembly generally designated by the numeral 40, cooperable with stylus arm 22.

Figure 2:
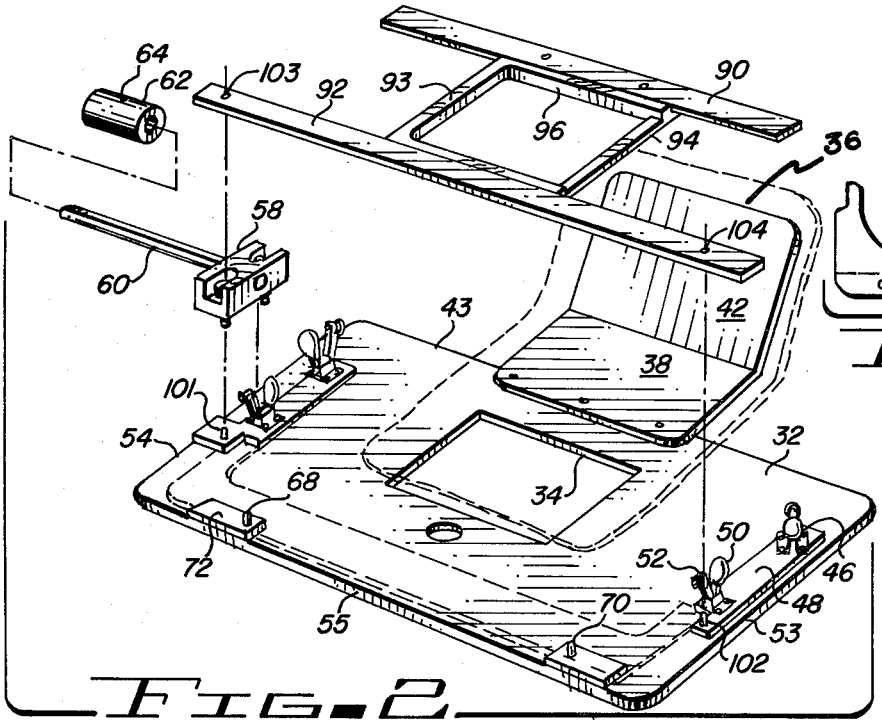
FIG. 2 is an exploded perspective view showing the components of the gauging assembly.

The gauging assembly 30 is shown in detail in FIG. 2 and includes a generally rectangular master gauge plate 32 having opposite sides 43 and 55 and ends 53 and 54. Master gauge plate 32 defines a generally rectangular opening or cut-out 34 over which the work piece is positioned during a sewing operation. If the operation is an engraving or similar operation, cut-out 34 would not be necessary.

A stand or easel 36 generally comprising vertical back plate 42 and a horizontal section 38 is positioned adjacent the cut-out 34 on gauge plate 32. Easel 36 properly positions and aligns the work piece on the gauge. For example, if a flap of a lady's handbag is being embroidered, the body of the bag will be placed on the easel 36 and the flap extended over the cut-out 34 as shown in dotted in FIG. 2.

A pair of locking devices 46 are adjacent opposite ends 53 and 54 of master gauge 32. Locking devices 46 are shown as toggle type locks having an actuating arm 50 and a lever 52. By depressing arm 50, lever 52 is moved to a generally horizontal locking position. An elongate bar 48 transversely positioned adjacent each of the ends 53 and 54 and serves as a mounting pad for the locking devices 46.

A connecting block 58 is secured to the master gauge at a medial location at end 54. A generally cylindrical shaft 60 projects from connecting block 58. Shaft 60 is adapted to be attached to the pantograph mechanism 12 at bracket 28 as shown in FIG. 1. An annular coupling 62 may be placed about connecting shaft 60 and placed in abutment with bracket 28 and affixed by set screw 64 to further stabilize the gauging device 10. Axial adjustment of the assembly 30 may be accomplished by adjusting the relative position of shaft 60 to coupling 62 to initially center the assembly relative to sewing head 20. Thereafter, similar operations may be repeatedly performed without further adjustment as the device is "centered."

Aligning pins 68 and 70 are positioned adjacent longitudinal edge 55 of master gauge 32. Aligning pins 68 and 70 are shown as secured on mounting pads 72 so the interchangeable gauges are elevated above the surface of the master gauge plate 32 when in position, as will be explained.

Figure 3A:
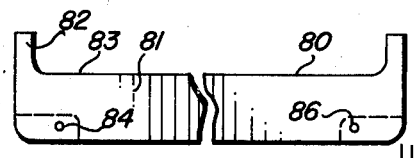
FIGS. 3A to 3D are plan views of representative interchangeable gauges that may be used with the gauging assembly of the present invention.
Figure 3B:
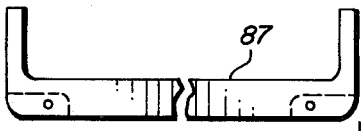
Figure 3C:
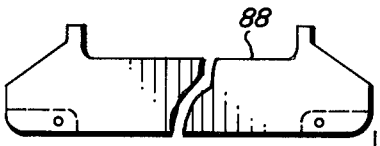
Figure 3D:
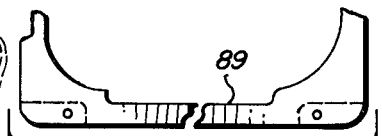
Figure 4:
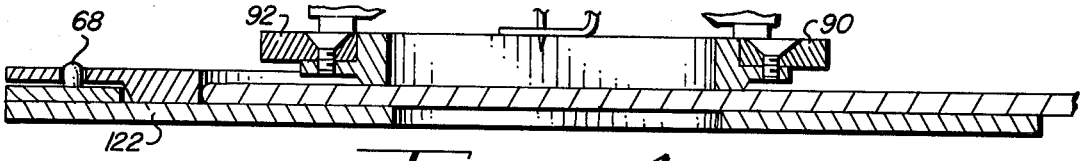
FIG. 4 is a sectional view taken along lines 4—4 of FIG. 1.
Figure 6:
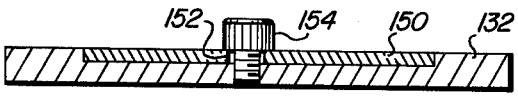
FIG. 6 is a section view taken along lines 6—6 of FIG. 1.
Figure 5:
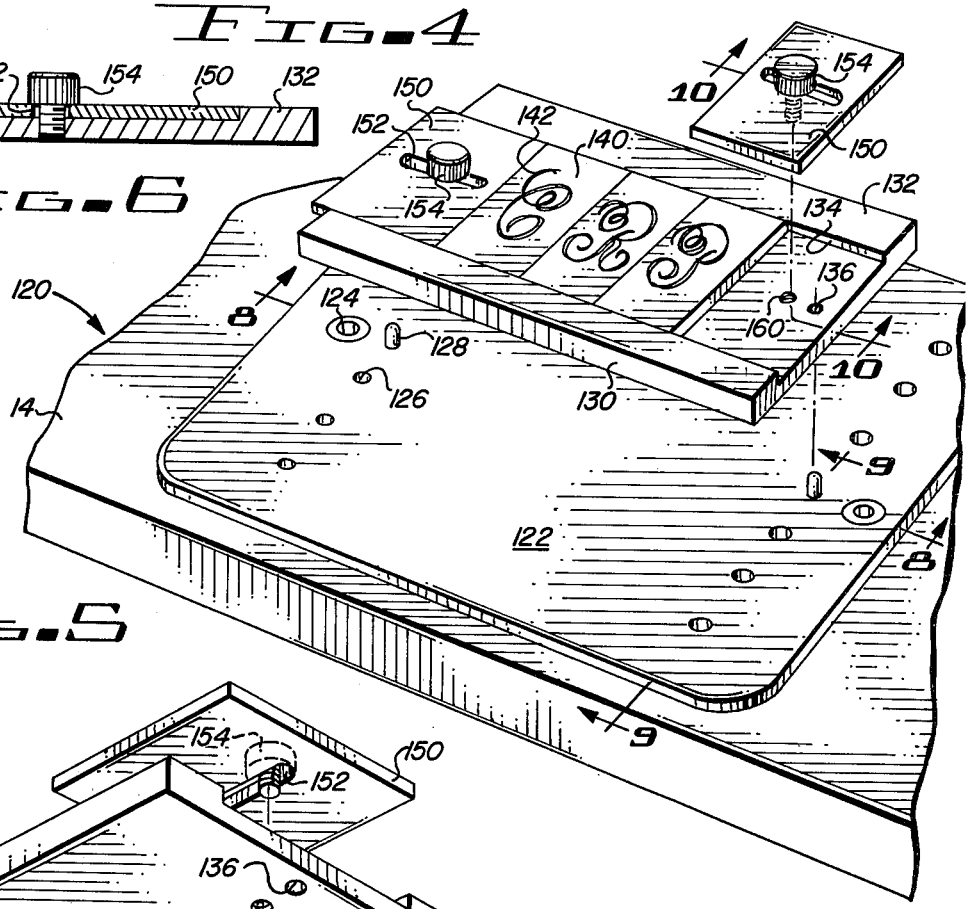
FIG. 5 is a partially exploded perspective view illustrating the template assembly.
Figure 7:
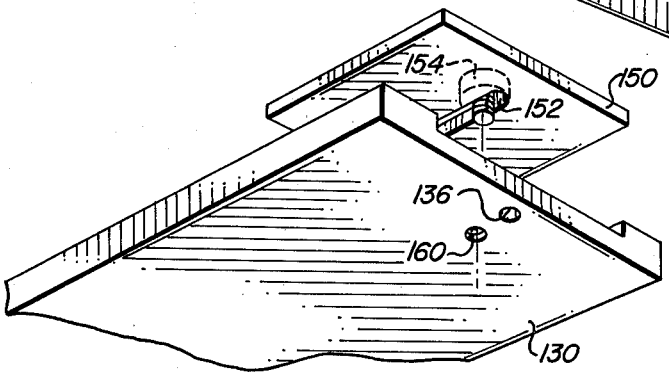
FIG. 7 is a bottom perspective view showing a portion of the template tray and template end plate.
Figure 8:
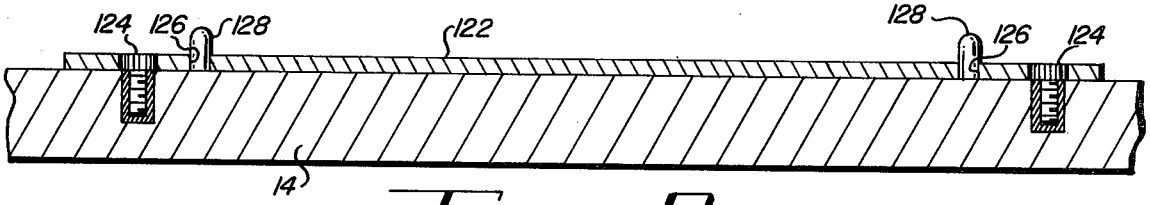
FIG. 8 is a sectional view of the template base taken along lines 8—8 of FIG. 5.
Figure 9:
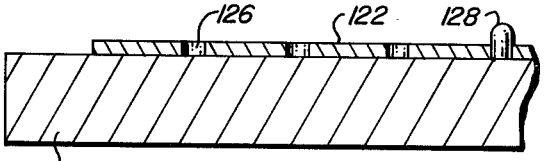
FIG. 9 is a sectional view taken along lines 9—9 in FIG. 5.
Figure 10:
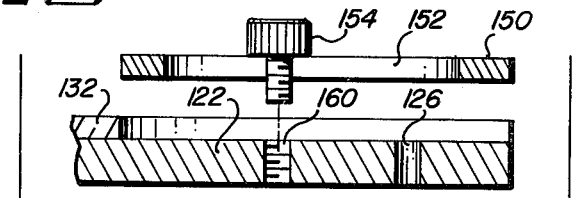
FIG. 10 is a sectional view of the template tray and end plate taken along lines 10—10 of FIG. 5.

Interchangeable gauges may be variously configured depending upon the shape of the work piece. Typical configurations are shown in FIGS. 3A to 3D. Referring to FIG. 3A, the interchangeable gauge 80 has an elongate body member 81 and laterally projecting arms 82 disposed at opposite ends of the body defining a longitudinal recess 83 which forms the gauging surface. Bores 84 and 86 are provided in the gauge near opposite ends of the body and are adapted to register with gauge alignment pins 68 and 70 on the master gauge. Interchangeable gauge 80 is positioned on the aligning pins as shown in dotted lines in FIG. 2 and in solid lines in FIG. 1. A detailed description of the various gauge configurations 87, 88 and 89, as shown in FIGS. 3B through 3D, is not deemed necessary because, as pointed out above, these gauges are representative of various configurations that would be typical in embroidering an article such as the flap or panel of a women's purse. It will be apparent to those skilled in the art that the shape and configuration of the interchangeable gauge plate and the recess forming the gauging surface generally corresponds to the shape of the work piece and may vary accordingly.

Clamping plate 90 is comprised of two parallel bars 91 and 92, connected by transverse arms 93 and 94 defining an opening 96. Opening 96 corresponds approximately to cut-out 34 in master gauge plate 32. Alignment pins 101 and 102 disposed adjacent opposite edges 54 and 53 of the gauge plate 32, respectively, are adapted to register with bores 103 and 104 in arm 92 of the clamping plate as shown in FIG. 1 and 2. The clamping is held in place by engagement by arms 52 of toggle locks 46.

The present invention also comprehends an improved template assembly which is shown in FIGS. 5 to 10 and is generally designed by the numeral 120. The template assembly includes a base plate 122 which is secured to the desk 14 at a position subjacent the stylus arm 22. The base plate can be secured to desk 14 by any convenient means such as rivet fasteners 124, as shown. Two parallel rows of alignment bors 126 extend transversely in base plate 122. The bores 126 are adapted to removably receive positioning pins 128. The pins 128 can be removed from any one of the bores 126 and moved to another bore to selectively position the template tray 130 to position the tray relative to the stylus to accommodate varying sizes and lateral positioning of the design or indicia to be applied to the work piece.

Template tray 130 has an elongate body 132 defining longitudinally extending slot 134. Bores 136 are provided at opposite ends of the slot 134. Bores 136 are positioned to align with pins 128 to selectively position the tray on the template base 122. Templates 140 carrying selected indicia 142 can be cooperably received in the slot 134. End plates 150 secure the templates in the tray slot 134. End plates 150 are generally rectangular having a transverse slot 152 receiving fastener 154 having a threaded body engageable in threaded bore 160 in the template tray so the size and number of templates can be conveniently changed.

The present invention will be more readily understood from the following description of the operation. Gauging device 30 and the template assembly 40 are first attached to a conventional engraving or monogramming machine in the manner described above and as shown in FIGS. 1 and 2. The gauging device is secured to the mounting bracket 28 of the motion translating mechanism 12 at connecting shaft 60 and coupling 62 and the position of the gauge is adjusted axially and vertically to obtain the proper relationship between the sewing head and gauge card stylus. The template assembly 40 is secured to the desk surface 14 of the machine immediately below the stylus arm 22. After installation, the operator places a work piece or article to be monogrammed on the easel 36; a lady's handbag being shown for purposes of illustration. Gauge 80 has been selected which conforms to the perimetric shape of the article or work piece. The gauge is placed on the master gauge by positioning bores 84 and 86 of the gauge on positioning pins 68 and 70. The gauge serves to center and correctly position the work piece during the operation. The clamping plate 90 is placed over the work piece and pins 101 and 102 inserted in bores 103 and 104, respectively. The locking devices 46 are actuated to secure the clamping plate in place thereby retaining the work piece against movement relative to the gauging assembly.

The operator then selects the appropriate template carrying the desired indicia. In a monogramming operation, the template would be similar to those shown in FIG. 6 carrying the desired initials. The templates are placed in the longitudinal slot 134 of the template tray 130. The end plates 150 are positioned in slot 134 at opposite sides of the template and tightened in place by turning fastener 154. The template tray and contained templates are positioned on the template base by registering pins 128 with aligning bores 136. The lateral position of the template tray 134 on the template base plate 122 can be adjusted by repositioning pins 128 with respect to template base plate. This causes an attendant displacement of the location of the application of the embroidery on the work piece secured on the gauging device.

The operator then proceeds with the sewing or engraving operation by tracing the stylus arm 22 and stylus 26 along the indicia on the template and actuating the sewing head or other device.

When the operation is completed, the operator can quickly and with facility disengage the clamping plate 90 and place a new work piece in position. The templates 140 can be quickly interchanged when new indicia are required to be monogrammed or embroidered or embossed on a work piece. The device is "self-centering" and repetitive operations on similar work pieces can be performed without further adjustment as the relationship of the work piece in the gauge, sewing head, stylus and templates is fixed. An opertion on a different work piece can be initiated by simply changing the gauge. The size of indicia can be easily changed by inserting a new template tray. The position of the indicia applied to the work piece can be adjusted by repositioning the tray with respect to plate 122.

It will be apparent that the machine of the present invention is highly effective for the intended purpose. The apparatus of the present invention is particularly suited for attachment to most conventional monogram and engraving machines utilizing motion translating devices of the pantograph type. The present apparatus is particularly adaptable to machines used in high production and commercial operations, such as monogramming initials on articles of clothing and accessories such as ladies handbags.

It will be obvious to those skilled in the art to make various changes, alterations and modifications to the embodiments herein described. To the extent that these changes, alterations and modifications do not depart from the spirit and scope of the appended claims, they are intended to be encompassed therein.

What is claimed is:

1. In a machine of the type having a motion translating mechanism for moving a workpiece at a first location and in response to movement imparted at a tracing mechanism at a second location, the improvement comprising:

(a) a base including connecting means for attaching said base to said motion translating mechanism at said first location;

(b) locking means carried on said base;

(c) detachable guaging means having an orienting surface corresponding to at least a portion of the workpiece, said detachable guaging means being cooperable with said locking means to detachably secure said guaging means to said base plate whereby said guaging means may be selectively interchanged; and (d) clamping means associated with said base for securing said workpiece on said base and in engagement with at least the orienting surface of said detachable guaging members whereby the workpiece is securable in a work position at said second location.

2. The motion translating machine of claim 1 further including an easel on said base for support of said work piece.

3. The motion translating machine of claim 1 wherein said clamping means comprises a clamping plate and locking means carried on said base for securing said clamping means in a clamped position.

4. The motion translating device of claim 1 further including a template assembly comprising:

(a) a base;

(b) a template tray for holding templates therein; and (c) means for adjustably and detachably securing said template to said base.

5. The motion translating device of claim 4 wherein said template tray defines a slot for slidably receiving templates therein.

6. The motion translating device of claim 5 further including end pieces for securing a template in said tray slot in a predetermined position.

* * * * *